US008267023B2

(12) United States Patent
Samilo

(10) Patent No.: US 8,267,023 B2
(45) Date of Patent: Sep. 18, 2012

(54) APPARATUS AND METHOD FOR MULTIPLE YARN COLOR AND MULTIPLE PILE HEIGHT TUFTING MACHINE

(75) Inventor: John Samilo, Ringgold, GA (US)

(73) Assignee: CYP Technologies, Inc., Chattanooga, TN (US)

( * ) Notice: Subject to any disclaimer, the term of this patent is extended or adjusted under 35 U.S.C. 154(b) by 181 days.

(21) Appl. No.: 12/451,970

(22) PCT Filed: Jun. 13, 2008

(86) PCT No.: PCT/US2008/007500

§ 371 (c)(1),
(2), (4) Date: Dec. 8, 2009

(87) PCT Pub. No.: WO2008/156733

PCT Pub. Date: Dec. 24, 2008

(65) Prior Publication Data

US 2010/0162932 A1 Jul. 1, 2010

Related U.S. Application Data

(60) Provisional application No. 60/934,339, filed on Jun. 13, 2007.

(51) Int. Cl.
*D05C 15/00* (2006.01)

(52) U.S. Cl. ..... 112/80.01

(58) Field of Classification Search ..... 112/470.09, 112/98, 103, 220, 221, 80.5, 80.01, 80.08, 112/2.2, 7, 475.19

See application file for complete search history.

(56) References Cited

U.S. PATENT DOCUMENTS

| | | | | |
|---|---|---|---|---|
| 3,595,185 | A * | 7/1971 | Shorrock et al. | 112/80.08 |
| 4,127,078 | A | 11/1978 | Spanel et al. | |
| 5,079,908 | A | 1/1992 | Stahlecker | |
| 5,080,028 | A * | 1/1992 | Ingram | 112/80.08 |
| 5,165,352 | A * | 11/1992 | Ingram | 112/80.08 |
| 5,549,064 | A * | 8/1996 | Padgett, III | 112/410 |
| 5,599,393 | A | 2/1997 | Elvidge et al. | |
| 5,983,815 | A * | 11/1999 | Card | 112/80.73 |
| 6,877,449 | B2 * | 4/2005 | Morgante et al. | 112/475.23 |
| 7,634,326 | B2 * | 12/2009 | Christman et al. | 700/131 |
| 7,814,850 | B2 * | 10/2010 | Bearden | 112/80.4 |
| 2006/0260524 | A1 | 11/2006 | Cho | |

* cited by examiner

*Primary Examiner* — Tejash Patel
(74) *Attorney, Agent, or Firm* — Chambliss, Bahner and Stophel, P.C.

(57) ABSTRACT

A tufting machine comprising a yarn applicator adapted to receive feed yarn and penetrate a surface covering backing and a cutting means adapted to cut the feed yarn to produce a stitch. The tufting machine also comprises a yarn control module that includes a yarn feed wheel adapted to guide the feed yarn, an actuator adapted to move the yarn feed wheel between an engaged position and a disengaged position, and a yarn feed gear adapted to engage the feed yarn when the actuator moves the yarn feed wheel into the engaged position. The tufting machine further comprises a power source adapted to move the yarn feed gear and a remote process control computer system adapted to send a first signal and a second signal to the yarn control module. The tufting machine produces a patterned surface covering having a plurality of yarn colors and a plurality of pile heights.

20 Claims, 10 Drawing Sheets

FIGURE 8
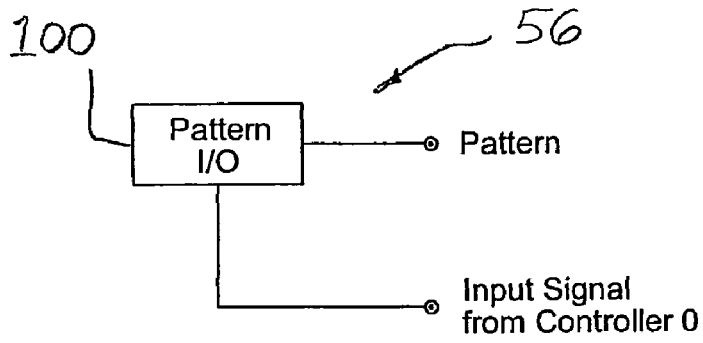
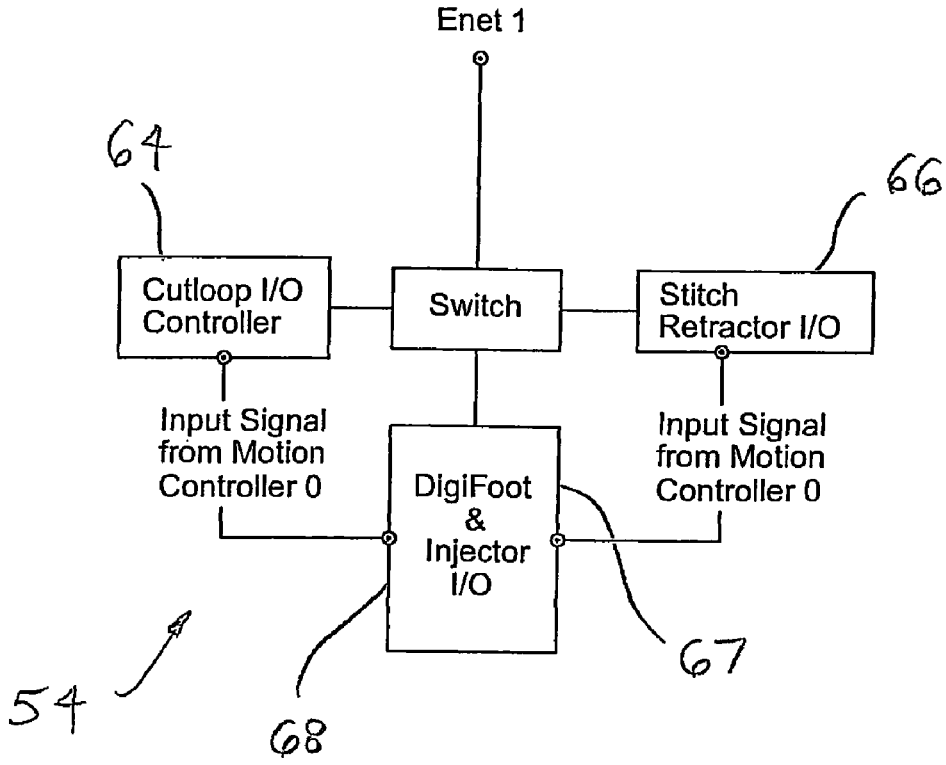
FIGURE 7

APPARATUS AND METHOD FOR MULTIPLE YARN COLOR AND MULTIPLE PILE HEIGHT TUFTING MACHINE

CROSS-REFERENCES TO RELATED APPLICATIONS/PATENTS

This application relates back to and claims priority from U.S. Provisional Application for Patent Ser. No. 60/934,339 filed on Jun. 13, 2007 and entitled Apparatus and Method for Multiple Yarn Color and Pile Height Tufting Machine.

FIELD OF THE INVENTION

The present invention relates generally to tufting machines adapted to produce surface coverings, and particularly to tufting machines adapted to produce patterned surface coverings having multiple yarn colors or multiple pile heights.

BACKGROUND AND DESCRIPTION OF THE PRIOR ART

It is known to produce patterned surface coverings with one or more yarn colors using a tufting machine. It is also known to produce patterned surface coverings having one or more pile heights using a tufting machine. However, conventional tufting machines and methods for producing patterned surface coverings suffer from several disadvantages. For example, conventional tufting machines and methods for producing patterned surface coverings are not capable of producing a patterned surface covering having multiple yarn colors and multiple pile heights. Conventional tufting machines are also not capable of producing a patterned surface covering made from a variety of different stitch materials in either a loop or cut stitch.

It would be desirable, therefore, if an apparatus and method could be provided that would produce a patterned surface covering having multiple yarn colors and multiple pile heights. It would also be desirable if an apparatus and method could be provided that would produce a patterned surface covering made from a variety of different stitch materials in either a loop or cut stitch.

ADVANTAGES OF THE PREFERRED EMBODIMENTS OF THE INVENTION

Accordingly, it is an advantage of the preferred embodiments of the invention claimed herein to provide an apparatus and method that produces a patterned surface covering having multiple yarn colors and multiple pile heights. It is also an advantage of the preferred embodiments of the invention to provide an apparatus and method that produces a patterned surface covering made from a variety of different stitch materials in either a loop or cut stitch.

Additional advantages of the preferred embodiments of the invention will become apparent from an examination of the drawings and the ensuing description.

Explanation Of Technical Terms

As used herein, the term "surface covering" shall mean any type of apparatus, manufacture or composition of matter adapted to partially or entirely cover a surface such as a floor, a wall and the like. The term "surface covering" includes without limitation artificial turf, synthetic grass, carpeting, rugs, wall hangings and the like.

As used herein, the terms "stitch" and "yarn" shall mean any type of material that may be penetrated into and through the backing of a surface covering. The terms "stitch" and "yarn" include without limitation all materials used to produce artificial turf, synthetic grass, carpeting, rugs, wall hangings and the like.

SUMMARY OF THE INVENTION

The invention comprises a tufting machine adapted to produce a surface covering having a pattern. The tufting machine comprises a yarn applicator that is adapted to receive feed yarn and penetrate a surface covering backing. The tufting machine also comprises a cutting means that is adapted to cut the feed yarn to produce a stitch. The tufting machine further comprises a yarn control module that includes a yarn feed wheel which is adapted to guide the feed yarn. The yarn control module also includes an actuator that is adapted to move the yarn feed wheel between an engaged position and a disengaged position. The yarn control module further includes a yarn feed gear that is adapted to engage the feed yarn when the actuator moves the yarn feed wheel into the engaged position. The tufting machine also includes a power source that is adapted to move the yarn feed gear and a remote process control computer system that is adapted to send a first signal and a second signal to the yarn control module. The tufting machine is adapted to produce a patterned surface covering having a plurality of yarn colors and a plurality of pile heights.

In the preferred embodiments of the tufting machine, the remote process control computer system comprises four subsystems. The preferred first subsystem is adapted to provide data relating to each stitch and permit an operator to control the movement of the tufting machine. The preferred second subsystem adapted to control the cutting means of the tufting machine and the conveyance of air by the digital presser foot injector and the funnel block injector. The preferred third subsystem is adapted to control the pattern of the surface covering. The preferred fourth subsystem is adapted to control the power source.

The invention also comprises a method for producing a surface covering having a plurality of yarn colors and a plurality of pile heights. The method comprises providing a tufting machine as described above. The method also comprises sending a first signal adapted to control the movement of the yarn feed gear to the yarn control module and controlling the movement of the yarn feed gear. The method further comprises sending a second signal adapted to control the movement of the actuator to the yarn control module and controlling the movement of the actuator.

In the preferred embodiments of the method for producing a surface covering having a plurality of yarn colors and a plurality of pile heights, the method further comprises controlling the movement of the cutting means.

BRIEF DESCRIPTION OF THE DRAWINGS

The presently preferred embodiments of the invention are illustrated in the accompanying drawings, in which like reference numerals represent like parts throughout, and in which:

FIG. 7 is a schematic illustration of the preferred cut-loop subsystem in accordance with the present invention.

FIG. 8 is a schematic illustration of the preferred pattern subsystem in accordance with the present invention.

DESCRIPTION OF THE PREFERRED EMBODIMENTS OF THE INVENTION

Figure 1:
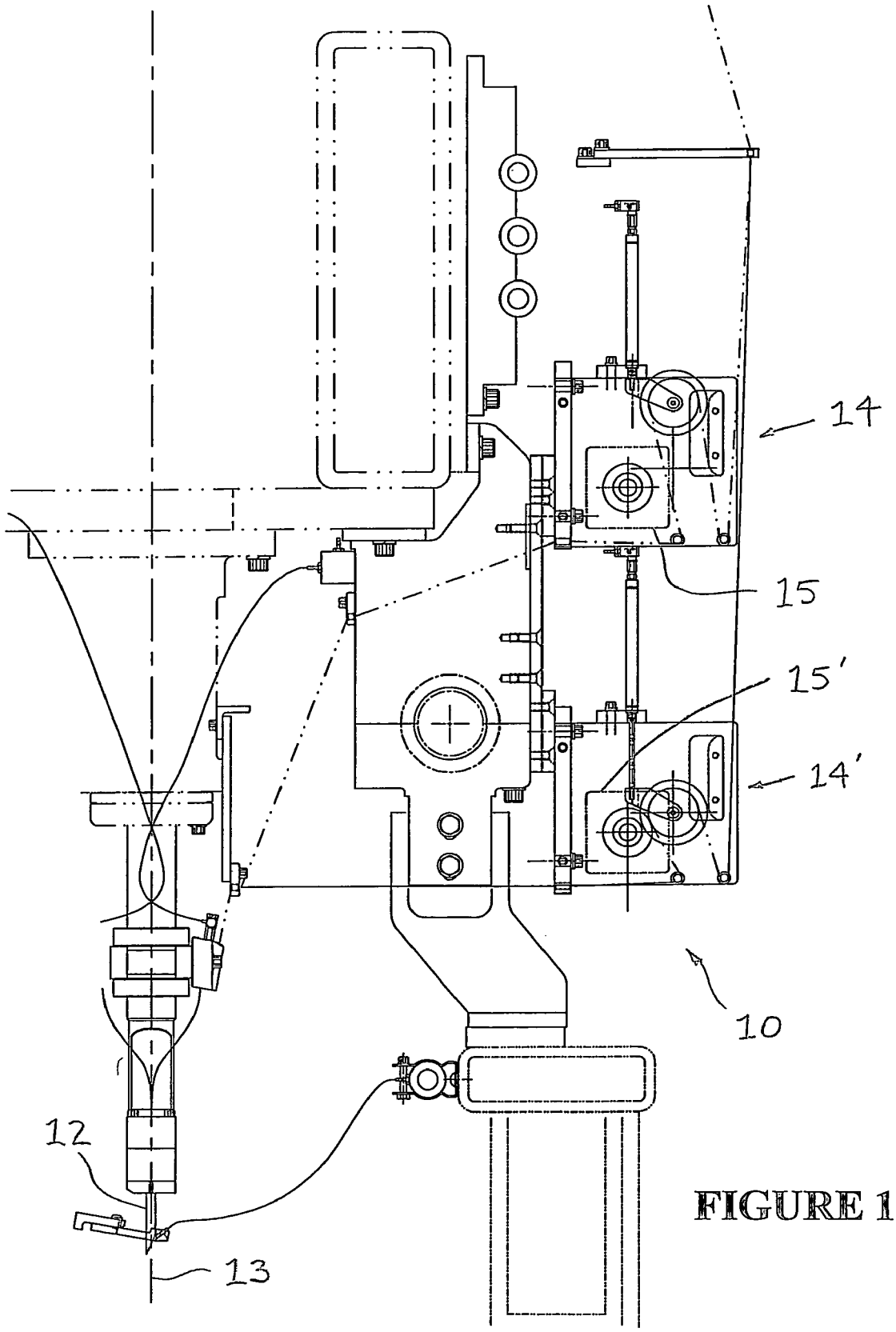
FIG. 1 is a partial sectional front view of the preferred apparatus in accordance with the present invention.

Referring now to the drawings, the preferred embodiments of the apparatus and method for patterned surface covering are illustrated by FIGS. 1 through 9. As shown in FIGS. 1 through 9, the preferred apparatus and method of the invention are adapted to produce a patterned surface covering having multiple yarn colors and multiple pile heights. Referring now to FIG. 1, the preferred tufting machine is designated generally by reference numeral 10. As shown in FIG. 1, the preferred tufting machine 10 includes a yarn applicator such as hollow needle 12 for receiving feed yarn and penetrating the backing of a surface covering and implanting the yarn or stitch in the backing. The preferred hollow needle 12 is adapted to receive and implant a plurality of different strands of yarn. The preferred tufting machine 10 includes a plurality of reciprocating hollow needles arranged in a row. In addition, preferred tufting machine 10 includes a cutting means such as knife or blade 13 adapted to cut the feed yarn to produce a stitch.

Still referring to FIG. 1, the preferred tufting machine 10 includes a power source such as an electric motor for supplying a predetermined length of the yarn to the hollow needle 12. Preferably, tufting machine 10 comprises a plurality of yarn control modules 14 and 14' and a plurality of electric motors 15 and 15' for selectively feeding strands of yarn to a row of reciprocating hollow needles for producing a patterned surface covering. The preferred electric motors 15 and 15' are operable to selectively advance the predetermined length of yarn to hollow needle 12, and alternatively, hold the yarn or retract the yarn from the needle. Preferably, electric motors 15 and 15' are stepper motors, servo motors or a combination thereof.

Figure 2:
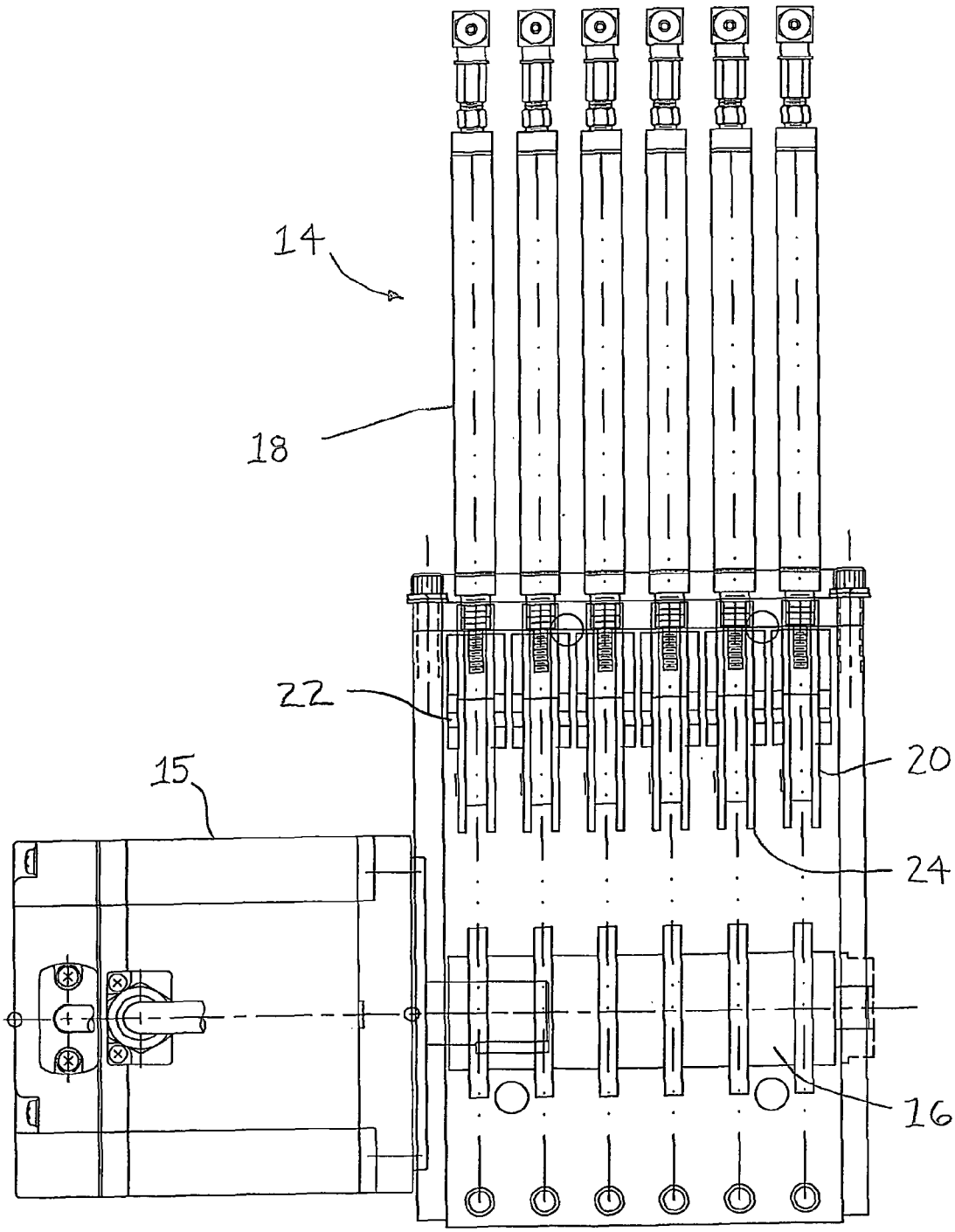
FIG. 2 is a partial sectional top view of the preferred modular supply system of the apparatus illustrated by FIG. 1.

Referring now to FIG. 2, the preferred tufting machine 10 includes a modular supply system and a corresponding modular control system comprising one or more yarn control modules 14. Each preferred yarn control module 14 includes a power source such as electric motor 15 that is operatively connected to a yarn feed drive unit 16. The preferred yarn feed drive unit 16 includes a gear, a knurled device or a combination thereof. Each preferred yarn control module 14 also includes one or more actuators 18. The preferred actuators 18 are hydraulic or pneumatic cylinders. Preferably, each yarn control module includes no more than eight actuators. Each preferred yarn control module 14 also includes one or more yarn feed wheels 20. The preferred yarn feed wheels 20 are adapted to guide the feed yarn and are attached to actuators 18 by clevis 22 (see also FIGS. 3-4). The preferred yarn feed wheels 20 are made from aluminum or plastic and machined so as to have a flange 24 on each outer edge. The preferred yarn feed wheels 20 are adapted to be moved between an upper position (disengaged position) and a lower position (engaged position) (see FIGS. 3-4) by actuator 18. The preferred flanges 24 act as guides to prevent yarn from wandering off of the edges of the wheel. As the preferred yarn feed wheels 20 are moved between the upper (disengaged) and lower (engaged) positions, the preferred flanges 24 are guided by guide 26 (see FIGS. 3-4).

Figure 3:
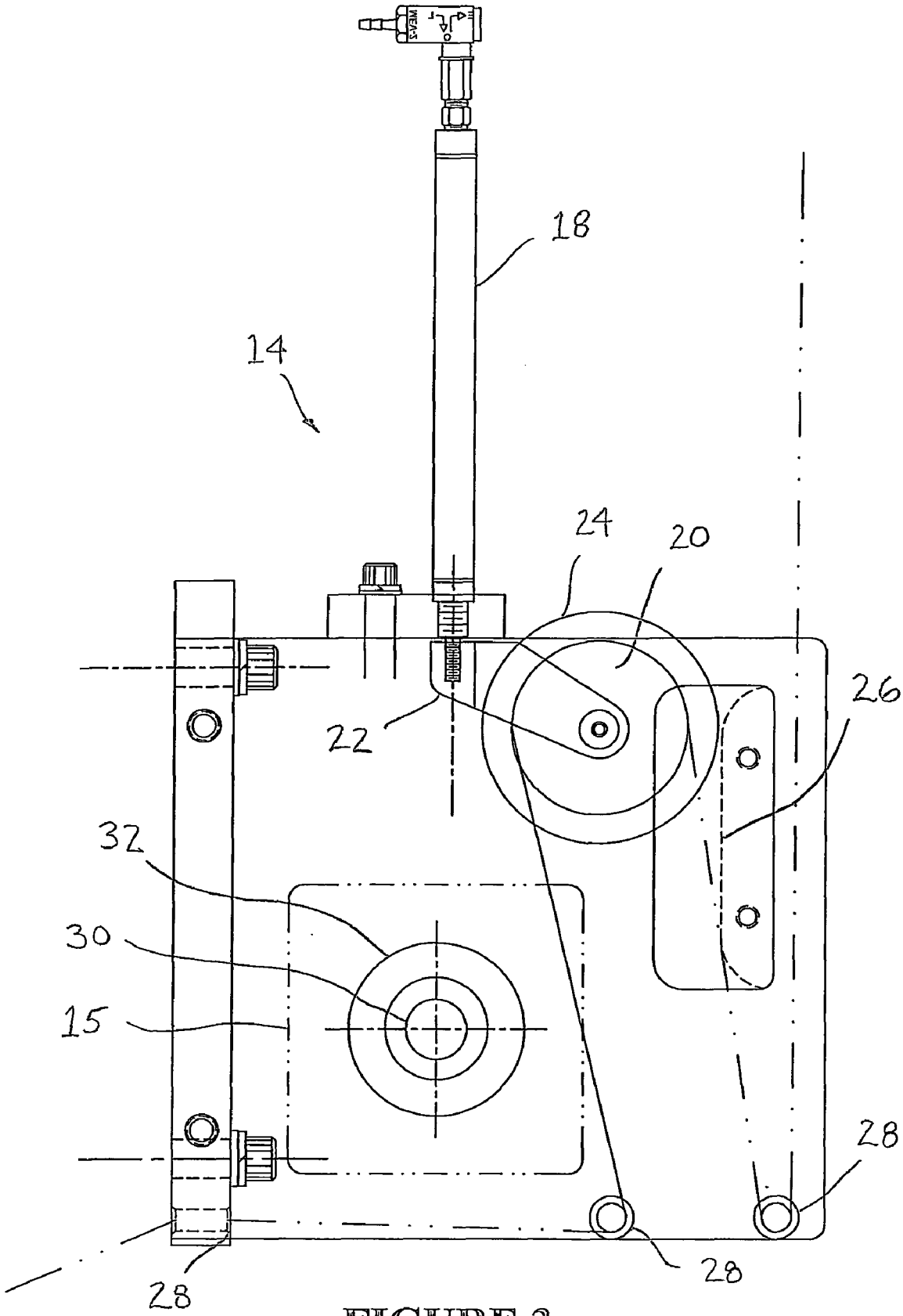
FIG. 3 is a partial sectional front view of the preferred upper modular supply system illustrated by FIGS. 1-2.

Referring now to FIG. 3, preferred yarn control module 14 is illustrated in its disengaged or non-operating position. As shown in FIG. 3, preferred actuator 18 is retracted and preferred yarn feed wheel 20 is in the disengaged or upper position. When the preferred yarn feed wheel 20 is in the upper position, preferred flanges 24 are guided by guide 26. The preferred guide 26 is comb-shaped and made from UHMW or some other similar plastic material. The preferred guide is also adapted to prevent rotation of yarn feed wheel 20 around the central axis of the actuator 18. As shown in FIG. 3, a system of yarn path guides 28 are arranged so as to provide an optimum path for yarn presentation (entrance) to the yarn feed gears and an escape (exit) path for the presentation of the feed yarn to the hollow needle.

Referring still to FIG. 3, when preferred yarn control module 14 is in its disengaged or non-operating position, yarn feed motor shaft 30 and yarn feed gear 32 are stationary. The preferred yarn feed gear 32 is operatively connected to motor 15 by yarn feed motor shaft 30. Also in the disengaged or non-operating position, actuator 18, yarn feed wheel 20 and clevis 22 are retracted upward and away from motor 15, yarn feed motor shaft 30 and yarn feed gear 32. In the disengaged or non-operating position, forward motion or feeding of the yarn is prevented and any yarn that may have been previously presented or fed into the hollow needle is retracted from the needle.

Figure 4:
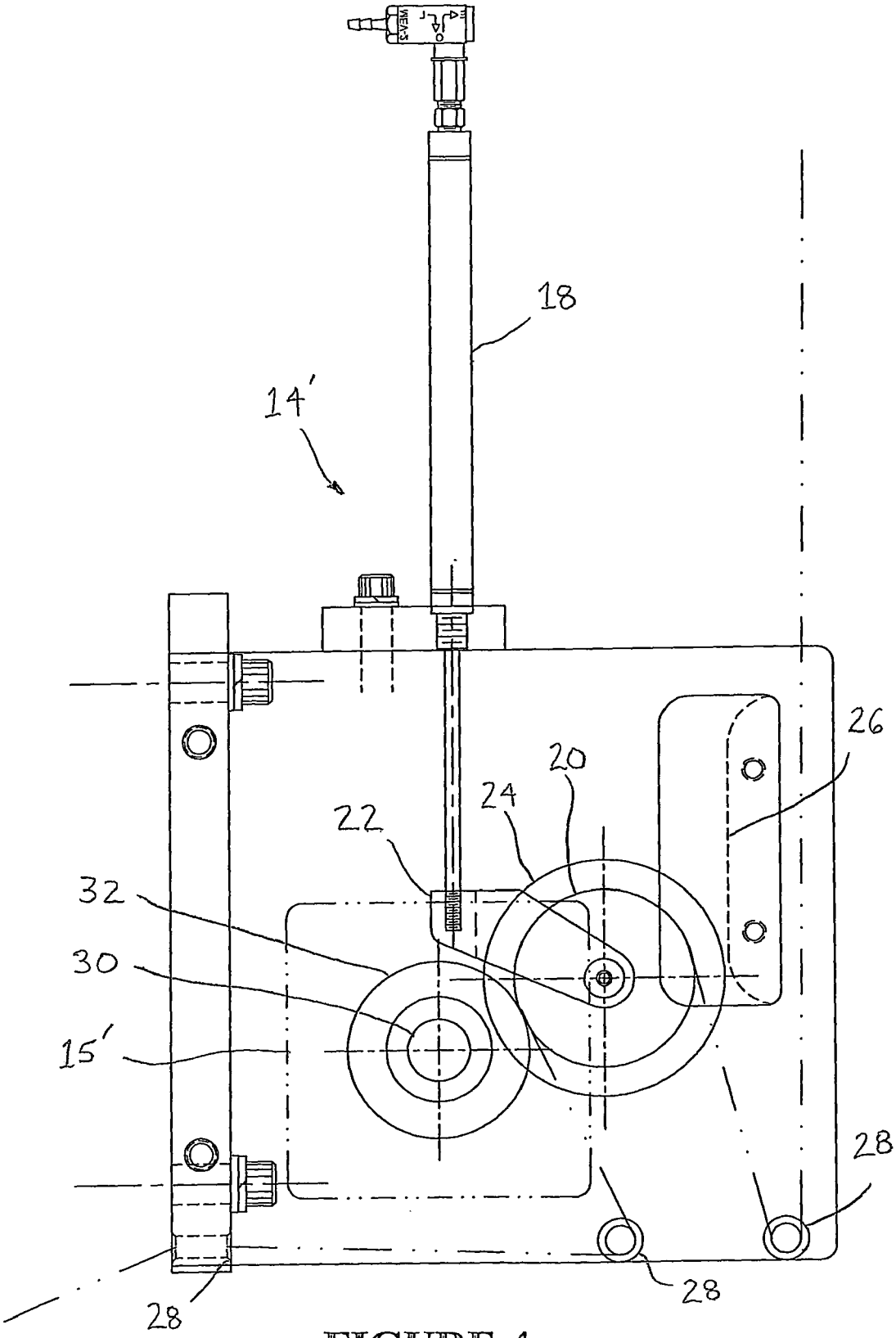
FIG. 4 is a partial sectional front view of the preferred lower modular supply system illustrated by FIGS. 1-2.

Referring now to FIG. 4, preferred yarn control module 14' is illustrated in its engaged or operating position. As shown in FIG. 4, preferred actuator 18 is extended and preferred yarn feed wheel 20 is in the lower position. More particularly, the preferred yarn feed wheel 20 is moved to the lower position by extended actuator 18. In the lower or engaged position, the preferred flanges 24 are still guided by guide 26. In the operating or engaged position, the yarn carried on preferred yarn feed wheel 20 engages yarn feed gear 32, and yarn feed gear 32 engages the feed yarn. Further, in the operating position, the preferred yarn control module is adapted to feed or move yarn toward hollow needle 12.

Figure 5:
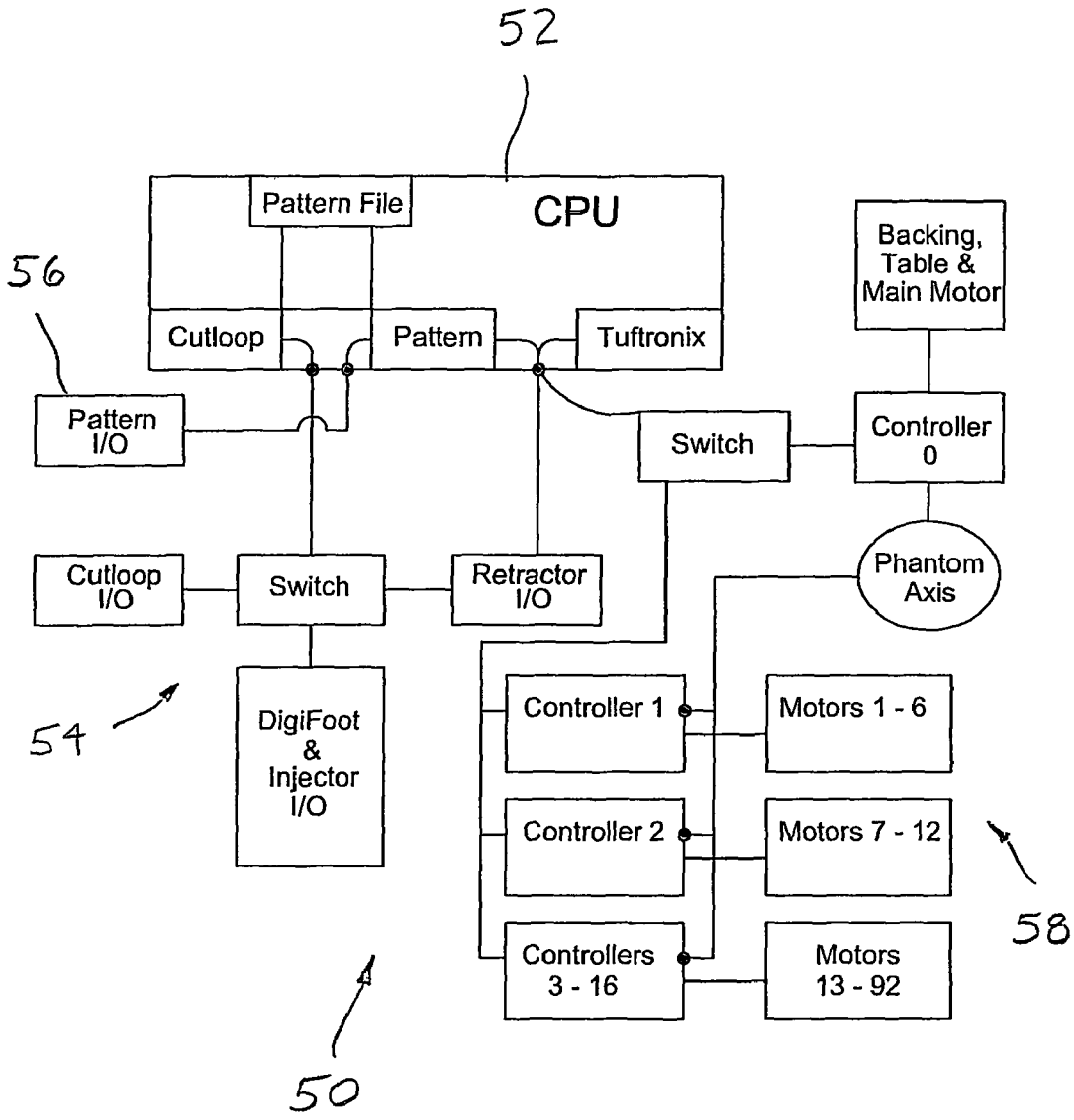
FIG. 5 is a schematic illustration of the preferred control system in accordance with the present invention.

Preferably, pattern information and timing signals are sent to each yarn control module by a remote process control computer system. Referring now to FIG. 5, a schematic view of the preferred system is illustrated. As shown in FIG. 5, the preferred system is designated generally by reference numeral 50. The preferred system 50 comprises four subsystems. The first subsystem is preferably CPU subsystem 52, the second subsystem is preferably cut-loop subsystem 54, the third subsystem is preferably pattern subsystem 56, and the fourth subsystem is preferably Tuftronix subsystem 58. The preferred cut-loop subsystem 54, the preferred pattern subsystem 56 and the preferred Tuftronix subsystem 58 include both software and the hardware controlled by the software.

Figure 6:
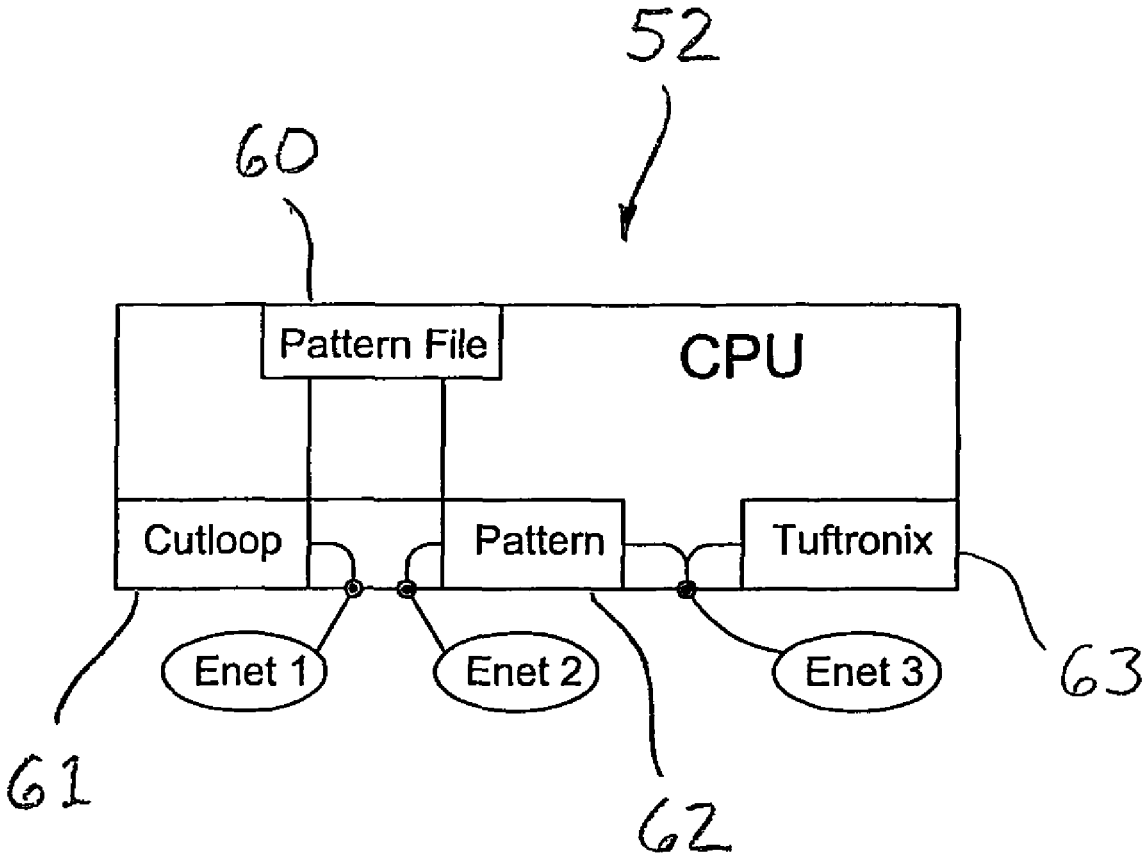
FIG. 6 is a schematic illustration of the preferred CPU subsystem in accordance with the present invention.

Referring now to FIG. 6, a schematic view of the preferred CPU subsystem 52 is illustrated. As shown in FIG. 6, the preferred CPU subsystem includes pattern file 60 which includes all of the information and data relating to what the surface covering should look like. The preferred pattern file 60 includes the location or placement of every stitch, whether the stitch is cut or loop, the stitch color, the total length of each stitch, the total width of each stitch, and the pile height of each stitch. The beginning of the preferred pattern file 60 contains the information and data relating to the overall dimensions of the surface covering. The body of the preferred pattern file 60 contains the actual stitch data. The preferred pattern file body consists of two bytes of data for each stitch. Preferably, the first byte includes color and cut/loop information and the second byte includes pile height information relating to the stitch.

Still referring to FIG. 6, the preferred CPU subsystem 52 also includes cut-loop software 61 and pattern software 62. Preferably, both cut-loop software 61 and pattern software 62 are written in Microsoft Visual Basic and each uses pattern file 60 to achieve its purpose. The preferred cut-loop software 61 and the preferred pattern software 62 each make a copy of pattern file 60 into RAM and use the copy for faster reading of data. The preferred cut-loop software 61 and the preferred pattern software 62 each use the data at the beginning of pattern file 60 to display to the user as well as to calculate stitch and gauge rates. The preferred cut-loop software 61 looks at the first byte of each byte pair for each stitch in the body of pattern file 60 in order to obtain cut/loop information about each stitch. The preferred cut-loop program 61 then determines, via various formulae, which of the needles gets which stitch and uses this information to send off/on data to the cut-loop input/output ("I/O") in the form of a string of "1"s and "0"s corresponding to the number of needles on the tufting machine. The preferred pattern software 62 reads both bytes of the byte pair to obtain both color and off/on information in order to send the pattern I/O and the pile height information to the motion controller output ("O"). The preferred pattern software 62 also uses a set of formulae similar to cut-loop software 61 to determine which of the needles is handling each stitch in pattern file 60 and to determine what color stitch should be engaged for each needle. The preferred pattern software 62 generates the color information as a whole byte at a time with only one color on at a time. For example, if eight different colors are being used, there would be one "1" and seven "0"s per needle so as to prevent multiple colors from being engaged at once.

Referring still to FIG. 6, the preferred CPU subsystem 52 also includes Tuftronix software 63. The preferred Tuftronix software 63 includes a front end graphical user interface ("GUI") and is written in Visual Basic. The preferred Tuftronix software 63 is adapted to permit the user or operator to control the movement of the tufting machine. The preferred Tuftronix software 63 also provides the user or operator with access to all of the settings for each surface covering, which may include backing tension, stitch rate, gauge rate, backlash, overlap, RPM rate of the tufting machine, and many other variables. The preferred Tuftronix software 63 is also responsible for homing the tufting machine and preparing it to operate as well as keeping up with the machine output in feet and the cycle counts of the current surface covering. Preferably, the Tuftronix software 63 sends all of the data to the motion controllers so that they can, in turn, activate the motors that power the tufting machine.

Figure 7A:
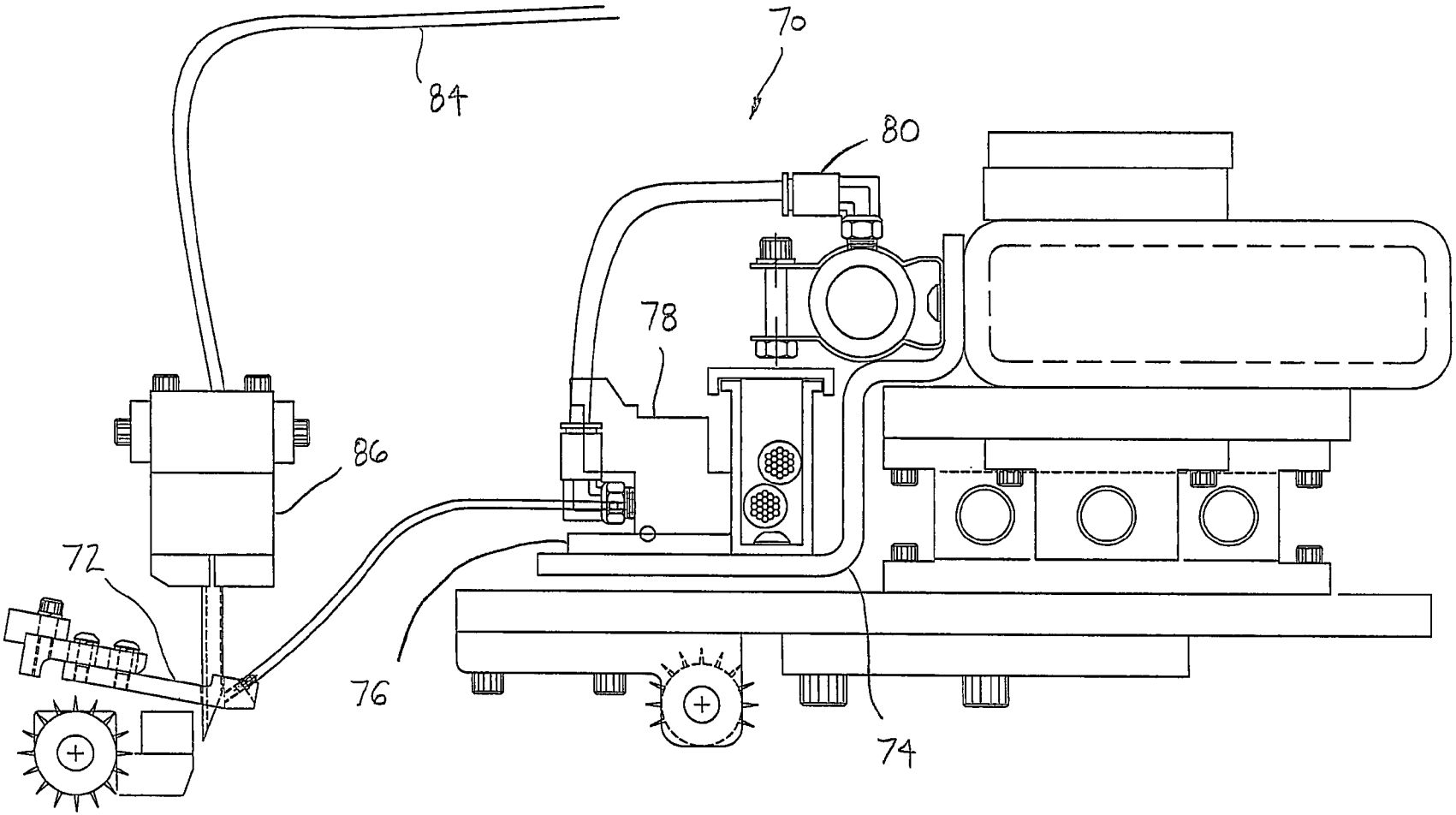
FIG. 7A is a front view of the preferred digital presser foot injector in accordance with the present invention.
Figure 7B:
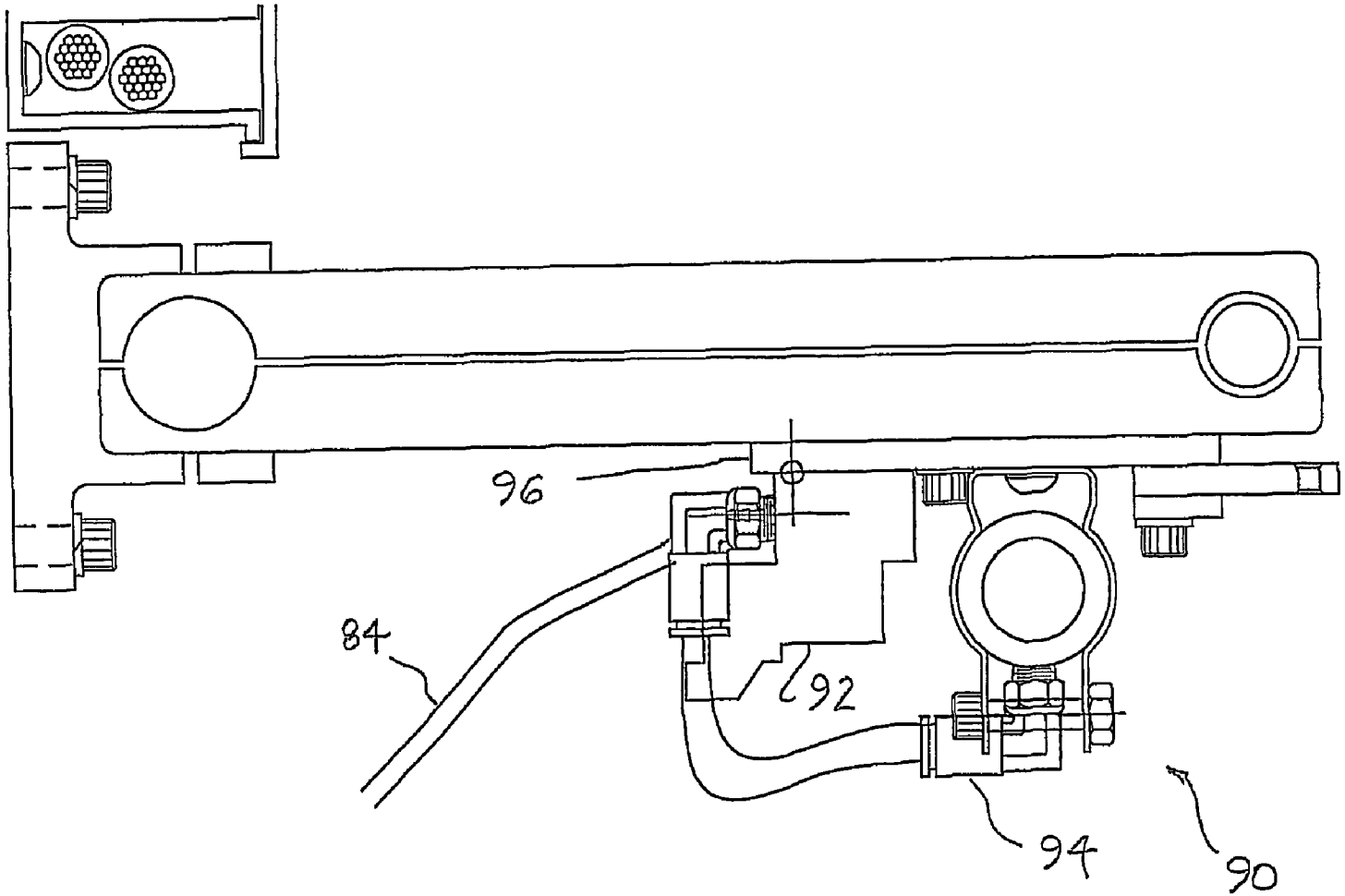
FIG. 7B is a front view of the preferred funnel block injector in accordance with the present invention.

Referring now to FIG. 7, a schematic view of the preferred cut-loop subsystem 54 is illustrated. The preferred cut-loop subsystem 54 is adapted to control the conveyance of air by the digital presser foot injector and the funnel block injector. See FIGS. 7A and 7B. As shown in FIG. 7, preferred cut-loop subsystem 54 comprises the actual cut-loop I/O 64 and three other devices controlled by cut-loop software 61; namely, stitch retractor I/O 66, digital presser foot injector I/O 67, and funnel block injector I/O 68. Preferably, the same type of digital I/O will control each of these four devices. The preferred digital I/O has two parts. First, the preferred digital I/O includes an I/O CPU having code that is programmed to take data from cut-loop software 61 and determine which cutting means (such as knives or blades) must be activated and when to activate them. Preferably, the data from the cut-loop software 61 includes a string of "1"s and "0"s which correspond to the number of needles on the tufting machine. Preferably, a "1" corresponds with on and a "0" corresponds with off. When the I/O CPU receives a signal from the motion controller, it activates the cutting means corresponding to the "1s" and turns off the cutting means corresponding to the "0"s.

Still referring to FIG. 7, the preferred stitch retractor I/O 66 receives data from cut-loop software 61. This data preferably consist of "1"s and "0"s similar to the cut-loop I/O 64. Preferably, a "1" instructs the I/O to pull out the next stitch and a "0" instructs the I/O to do nothing. The output from the I/O is preferably connected to small digital solenoids that activate the stitch retractor and pull out the previous stitch. The preferred digital presser foot injector and the preferred funnel block injector share a single I/O system, as both of them preferably use the same set of data from cut-loop software 61. The preferred digital presser foot injector and the preferred funnel block injector are timed off of two individual input signals from a motion controller. Preferably, the digital presser foot injector and the funnel block injector are designed to conserve compressed air during operation of the tufting machine. The preferred digital presser foot injector and the preferred funnel block injector function substantially identically, but each toggles a different air system at slightly different times. The preferred digital presser foot injector conveys air to the pressure feet only while the needle is penetrating the backing of the surface covering. The preferred funnel block injector conveys injector air only while the stitch is being placed on the backing of the surface covering. In addition, the preferred digital presser foot injector and the preferred funnel block injector receive input data from cut-loop subsystem 54. The preferred input data comprises "1"s and "0"s and permits the digital presser foot injector and the funnel block injector to determine which needles are actually in use so that air is conveyed to only those needles that are in use.

Referring now to FIG. 7A, a front view of the preferred digital presser foot injector is illustrated. As shown in FIG. 7A, the preferred digital presser foot injector is designated generally by reference numeral 70. The preferred digital presser foot injector 70 is adapted to convey air to presser foot 72 when the yarn applicator is penetrating the surface covering backing. The preferred digital presser foot injector 70 is mounted on mounting bracket 74 and mounting bar 76 and includes at least one solenoid valve 78. Preferably, digital presser foot injector 70 conveys air to the presser foot via air manifold 80. In the preferred embodiments, line 84 extends from funnel block 86 to a funnel block injector (see FIG. 7B).

Referring now to FIG. 7B, a front view of the preferred funnel block injector is illustrated. As shown in FIG. 7B, the preferred funnel block injector is designated generally by reference numeral 90. The preferred funnel block injector 90 is adapted to convey air to funnel block 86 while the stitch is being placed in the surface covering backing. The preferred funnel block injector 90 includes at least one solenoid valve 92 and air supply manifold 94 mounted on mounting bar 96. Preferably, air supply manifold 94 is in fluid communication with funnel block 86 via line 84. See also FIG. 7A.

Referring now to FIG. 8, a schematic view of the preferred pattern subsystem 56 is illustrated. As shown in FIG. 8, the preferred pattern subsystem comprises one bank of digital pattern I/O 100 to control all of the plurality of yarn solenoids on the machine. Preferably, the digital pattern I/O 100 is the largest bank of I/O on the tufting machine and includes an output module for each needle on the machine, one input module, and four power modules. Like cut-loop subsystem 54, the preferred pattern subsystem 56 receives an input from motion controller 0 to time the switching of I/O. Also like cut-loop I/O 64, the preferred pattern subsystem 56 receives a string of "1"s and "0"s from pattern software 62 to determine which I/O must be turned on and which must be turned off.

Figure 9:
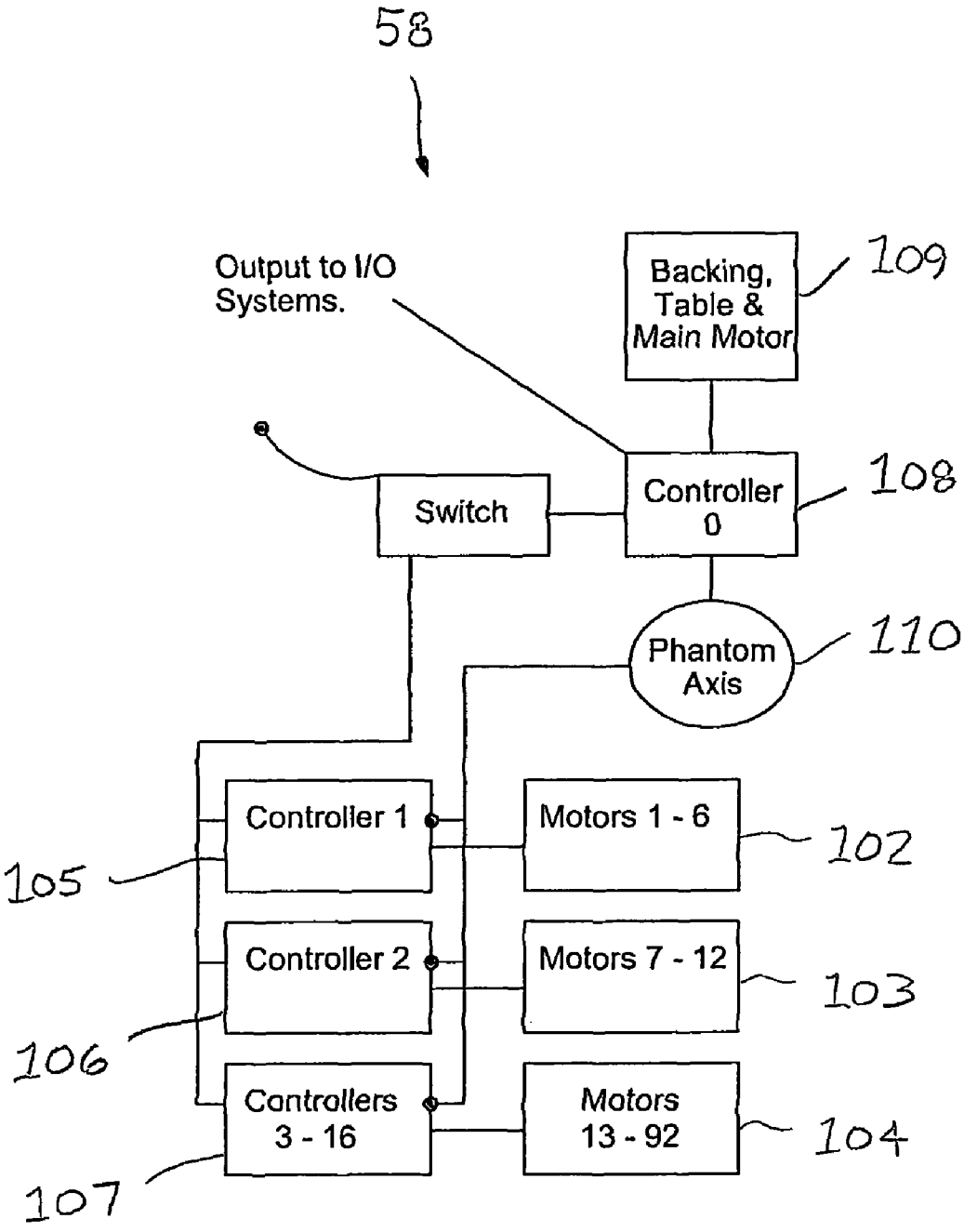
FIG. 9 is a schematic illustration of the preferred Tuftronix subsystem in accordance with the present invention.

Referring now to FIG. 9, a schematic view of the preferred Tuftronix subsystem 58 is illustrated. As shown in FIG. 9, the preferred Tuftronix subsystem 58 comprises motors 102, 103 and 104 and motion controllers 105, 106 and 107 which run the motors of the tufting machine. Preferably, each motion controller powers six motors and will be arranged as shown in a cascade. Each preferred motion controller has its own IP address and receives information from the Tuftronix and pattern front-ends in series. Preferably, the Tuftronix front-end controls homing of motors, speeds, and timing issues. The preferred pattern software 62 conveys pile height information to each of the plurality of motion controllers responsible for moving the plurality of yarn feed shafts.

Still referring to FIG. 9, the preferred motion controller 0 (designated by reference numeral 108) controls main shaft motor 109. The preferred motion controller 0 also generates phantom axis 110 which is adapted to keep motion controllers 105, 106 and 107 in time with main shaft motor 109. In addition, the preferred motion controller 0 produces all of the outputs to the I/O controllers in order to keep them in time with the system. The preferred phantom axis 110 is a copy of main shaft motor 109 which is the basis for the timing of all events. The preferred phantom axis 110 is generated by motion controller 0 and sent via a motor output on motion controller 0 which is daisy chained through all of the motion controllers 105, 106 and 107.

The invention also comprises a method for producing a surface covering having multiple yarn colors and multiple pile heights. According to the preferred method of the invention, a tufting machine having a modular yarn control system as described herein is provided. In addition, the preferred method comprises sending a signal to the one or more yarn control modules, controlling the movement of the yarn feed wheel and controlling the movement of feed yarn to the hollow needle. Preferably, pattern information and timing signals are sent to each yarn control module by a remote process control computer system such as the system described above. When the preferred modular yarn control system receives pattern and timing instructions prescribing that a stitch should be produced, a first signal is generated by the control system and sent to the associated yarn control module or modules. The first signal sent to the yarn control module(s) instructs the module(s) as to when, in the tufting cycle, to begin its (their) movement. The first signal also instructs the module(s) as to how far to rotationally move the yarn feed gear(s) and when to stop such rotational movement.

The preferred modular yarn control system also generates a second signal when the preferred modular yarn control system receives pattern information and/or timing signals prescribing that a stitch be produced. The second signal, like the first signal, is sent to the associated yarn control module or modules. The preferred second signal controls the extension and retraction of the actuators. Preferably, the second signal is sent to a solenoid valve (not shown) that is adapted to control the movement of the actuators. More particularly, the preferred solenoid valve is adapted to control the supply of compressed air or fluid to the actuators. Preferably, compressed air or fluid is supplied to the actuators via a flexible conduit. The compressed air or fluid supplied to the actuators cause the actuators to extend or retract as prescribed by the second signal. With the extension and retraction of an actuator, the associated yarn feed wheel and clevis move between the lower (or engaged) position and the upper (or disengaged) position, respectively. When the second signal causes an actuator to extend, the feed yarn may engage the yarn feed gear and motor assembly. After the actuator extends and the feed yarn engages the yarn feed gear and motor assembly, the motor performs the instruction sent by the first signal.

Upon completion of the movement of the actuator and the movement of the yarn feed gear, the modular yarn control system reads the next instruction from the pattern and timing instructions and determines if the next instruction is the same as or different from the previous instruction. More particularly, the preferred yarn control system reads the next instruction and determines if the previously-selected actuator is prescribed to provide the next stitch in the pattern matrix. If the previously-selected actuator is prescribed to provide the next stitch, no change is made to its position and the feed yarn remains in contact with the drive gear as it awaits the instruction regarding the rotational movement of the yarn feed gear. If, on the other hand, the next instruction prescribes that a different actuator is to provide the next stitch, the second signal to the associated solenoid is removed causing the actuator to retract and disengage the yarn feed gear. Simultaneously, the feed yarn will be retracted from the hollow needle.

In use, several advantages of the preferred embodiments of the invention are achieved. For example, the preferred embodiments of the invention provide an apparatus and method for producing a patterned surface covering having multiple yarn colors and multiple pile heights. The preferred embodiments of the invention also provide an apparatus and method for producing a patterned surface covering made from a variety of different stitch materials in either a loop or cut stitch.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A tufting machine adapted to produce a surface covering having a pattern, said tufting machine comprising:

(a) a yarn applicator, said yarn applicator being adapted to receive feed yarn and penetrate a surface covering backing;

(b) a cutting means, said cutting means being adapted to cut the feed yarn after the feed yarn and the yarn applicator penetrate the surface covering backing to produce a stitch;

(c) a yarn control module, said yarn control module comprising:

(1) a yarn feed wheel, said yarn feed wheel being adapted to guide the feed yarn;

(2) an actuator, said actuator being adapted to move the yarn feed wheel between an engaged position and a disengaged position;

(3) a yarn feed gear, said yarn feed gear being adapted to engage the feed yarn when the actuator moves the yarn feed wheel into the engaged position;

(4) a power source, said power source being adapted to move the yarn feed gear;

(d) a remote process control computer system, said remote process control computer system being adapted to send a first signal and a second signal to the yarn control module;

wherein said tufting machine is adapted to produce a patterned surface covering comprising a plurality of loops or cut stitches having a plurality of yarn colors and a plurality of pile heights.

2. The tufting machine of claim 1 wherein the yarn applicator is a hollow needle.

3. The tufting machine of claim 2 wherein the hollow needle is adapted to receive and implant a plurality of different strands of feed yarn.

4. The tufting machine of claim 1 wherein the actuator and the yarn feed wheel are attached by a clevis.

5. The tufting machine of claim 1 wherein the yarn feed wheel includes a flange on each outer edge.

6. The tufting machine of claim 5 wherein the flanges of the yarn feed wheel are guided by a guide.

7. The tufting machine of claim 1 wherein the power source is an electric motor.

8. The tufting machine of claim 1 wherein the power source and the yarn feed gear are operatively connected by a shaft.

9. The tufting machine of claim 1 wherein the remote process control computer system comprises a first subsystem adapted to provide data relating to each stitch and permit an operator to control the movement of the tufting machine.

10. The tufting machine of claim 1 further comprising:

(a) a digital presser foot injector, said digital presser foot injector being adapted to convey air to a presser foot when the yarn applicator is penetrating the surface covering backing;

(b) a funnel block injector, said funnel block injector being adapted to convey air to a funnel block while the stitch is being placed in the surface covering backing.

11. The tufting machine of claim 10 wherein the remote process control computer system comprises a second subsystem adapted to control the cutting means of the tufting machine and the conveyance of air by the digital presser foot injector and the funnel block injector.

12. The tufting machine of claim 1 wherein the remote process control computer system comprises a third subsystem adapted to control the pattern of the surface covering.

13. The tufting machine of claim 1 wherein the remote process control computer system comprises a fourth subsystem adapted to control the power source.

14. A method for producing a surface covering having a plurality of yarn colors and a plurality of pile heights, said method comprising:

(a) providing a tufting machine, said tufting machine comprising:

(1) a yarn applicator, said yarn applicator being adapted to receive feed yarn and penetrate a surface covering backing;

(2) a cutting means, said cutting means being adapted to cut the feed yarn after the feed yarn and the yarn applicator penetrate the surface covering backing to produce a stitch;

(3) a yarn control module, said yarn control module comprising:

(i) a yarn feed wheel, said yarn feed wheel being adapted to guide the feed yarn;

(ii) an actuator, said actuator being adapted to move the yarn feed wheel between an engaged position and a disengaged position;

(iii) a yarn feed gear, said yarn feed gear being adapted to engage the feed yarn when the actuator moves the yarn feed wheel into the engaged position;

(iv) a power source, said power source being adapted to move the yarn feed gear;

(4) a remote process control computer system, said remote process control computer system being adapted to send a first signal and a second signal to the yarn control module;

wherein said tufting machine is adapted to produce a patterned surface covering comprising a plurality of loops or cut stitches having a plurality of yarn colors and a plurality of pile heights;

(b) sending a first signal to the yarn control module; said first signal being adapted to control the movement of the yarn feed gear;

(c) controlling the movement of the yarn feed gear;

(d) sending a second signal to the yarn control module, said second signal being adapted to control the movement of the actuator; and (e) controlling the movement of the actuator.

15. The method of claim 14 wherein the remote process control computer system comprises a first subsystem adapted to provide data relating to each stitch and permit an operator to control the movement of the tufting machine.

16. The method of claim 14 wherein the tufting machine further comprises:

(a) a digital presser foot injector, said digital presser foot injector being adapted to convey air to a presser foot when the yarn applicator is penetrating the surface covering backing;

(b) a funnel block injector, said funnel block injector being adapted to convey air to a funnel block while the stitch is being placed in the surface covering backing.

17. The method of claim 16 wherein the remote process control computer system comprises a second subsystem adapted to control the cutting means of the tufting machine and the conveyance of air by the digital presser foot injector and the funnel block injector.

18. The method of claim 14 wherein the remote process control computer system comprises a third subsystem adapted to control the pattern of the surface covering.

19. The method of claim 14 wherein the remote process control computer system comprises a fourth subsystem adapted to control the power source.

20. The method of claim 14 further comprising controlling the cutting means.

* * * * *